United States Patent [19]

Goloff

[11] Patent Number: 4,661,042

[45] Date of Patent: Apr. 28, 1987

[54] COAXIAL TURBOMACHINE

[75] Inventor: Alexander Goloff, East Peoria, Ill.

[73] Assignee: Caterpillar Tractor Co., Peoria, Ill.

[21] Appl. No.: 433,474

[22] Filed: Jun. 18, 1984

[51] Int. Cl.[4] ..... F04D 29/56; F04D 13/02

[52] U.S. Cl. ..... 415/64; 415/66; 415/149 R

[58] Field of Search ..... 415/122 R, 149 R, 211, 415/60–69

[56] References Cited

U.S. PATENT DOCUMENTS

| | | | |
|---|---|---|---|
| 1,488,582 | 4/1924 | Allen | 415/143 |
| 2,318,990 | 5/1943 | Doran | 415/64 U X |
| 2,350,839 | 6/1944 | Szydlowski | 415/149 U X |
| 2,434,678 | 1/1948 | Szczeniowski | 415/69 |
| 2,566,550 | 9/1951 | Birmann | 415/211 X |
| 3,040,971 | 6/1962 | Pavlecka | 415/64 X |
| 3,314,647 | 4/1967 | Pavlecka | 415/64 X |
| 3,930,746 | 1/1976 | Kronogard | 415/211 X |
| 4,030,288 | 6/1977 | Davis et al. | 60/39.16 R |

FOREIGN PATENT DOCUMENTS

| | | | |
|---|---|---|---|
| 908121 | 4/1946 | France | 415/149 R |

*Primary Examiner*—Robert E. Garrett
*Assistant Examiner*—Joseph M. Pitko
*Attorney, Agent, or Firm*—Wood, Dalton, Phillips, Mason & Rowe

[57] ABSTRACT

A centrifugal compressor (10/110) or a centripetal turbine (76) having coaxially aligned, relatively rotatable rotors (12,112,212/14,114,214) mounting a plurality of blades (30,32,34,36,38/130/230) having variable radial extension from a central axis (15). The blades closer to the center of rotation of the rotors are operated at high speeds so to maximize their gas treating effect while rotating the larger diameter blades (40,42,44/132,232) at lower speeds commensurate with their stress capabilities.

8 Claims, 2 Drawing Figures

COAXIAL TURBOMACHINE

TECHNICAL FIELD

This invention relates generally to compressors or turbines for air or other gases and more particularly to centrifugal or radial flow compressors or turbines in which vanes are rotated within an annular passageway whose radial dimension varies progressively between its ends.

BACKGROUND ART

Radial flow rotary vaned machines are well known in the art. These machines can be constructed much more compactly and simply than can their axial flow counterparts.

Traditionally, centrifugal compressors and centripetal turbines have utilized a single rotor construction wherein the blades carried by the rotor are rotated at a uniform angular velocity. Centrifugal forces on the blade portions disposed furthest from the rotational axis tend to elongate the blades, and at high speeds could precipitate blade failure. To obviate this problem, the rotor is often operated at lower speeds to reduce loading on the most heavily stressed blades. As a result, those stages closest to the center of the rotor contribute relatively little to the treatment of the gas contained by the machine.

Exemplary of the state of the art is the forward compressor section of the turbine engine shown in the U.S. Pat. No. 4,030,288 issued to Davis et al. The compressor section comprises two longitudinally displaced bladed rotor sections, which operate at the same tip speeds, and a diffusion chamber intermediate the rotor sections. The radial extension of the blades, from the rotational axis of a shaft, increases progressively at each section toward the air outlet end. At high speeds the blade portions which are disposed furthest from the rotational axis experience the greatest tip speeds, and are severely stressed.

The present invention is directed to overcoming one or more of the problems as set forth above.

DISCLOSURE OF THE INVENTION

In one aspect of the present invention, a plurality of coaxially aligned blade carrying means, including a first and second blade carrying means, comprise a portion of a rotary vaned machine wherein the first and second blade carrying means are relatively rotatable, each to the other.

In another aspect of the present invention the first blade carrying means is rotating at a greater angular velocity than the second blade carrying means.

As a result, in a centrifugal compressor or centripetal turbine arrangement, the blades carried by one or more coaxially aligned rotors may be operated at different speeds. Those blades extending furthest from the rotational axis of the rotors, and otherwise experiencing the greatest stresses, can be operated at lower speeds, while the blades with a lesser radial extension may be operated at higher speeds sufficient that they effect significant treatment of the confined gas.

BEST MODE FOR CARRYING OUT THE INVENTION

Figure 1:
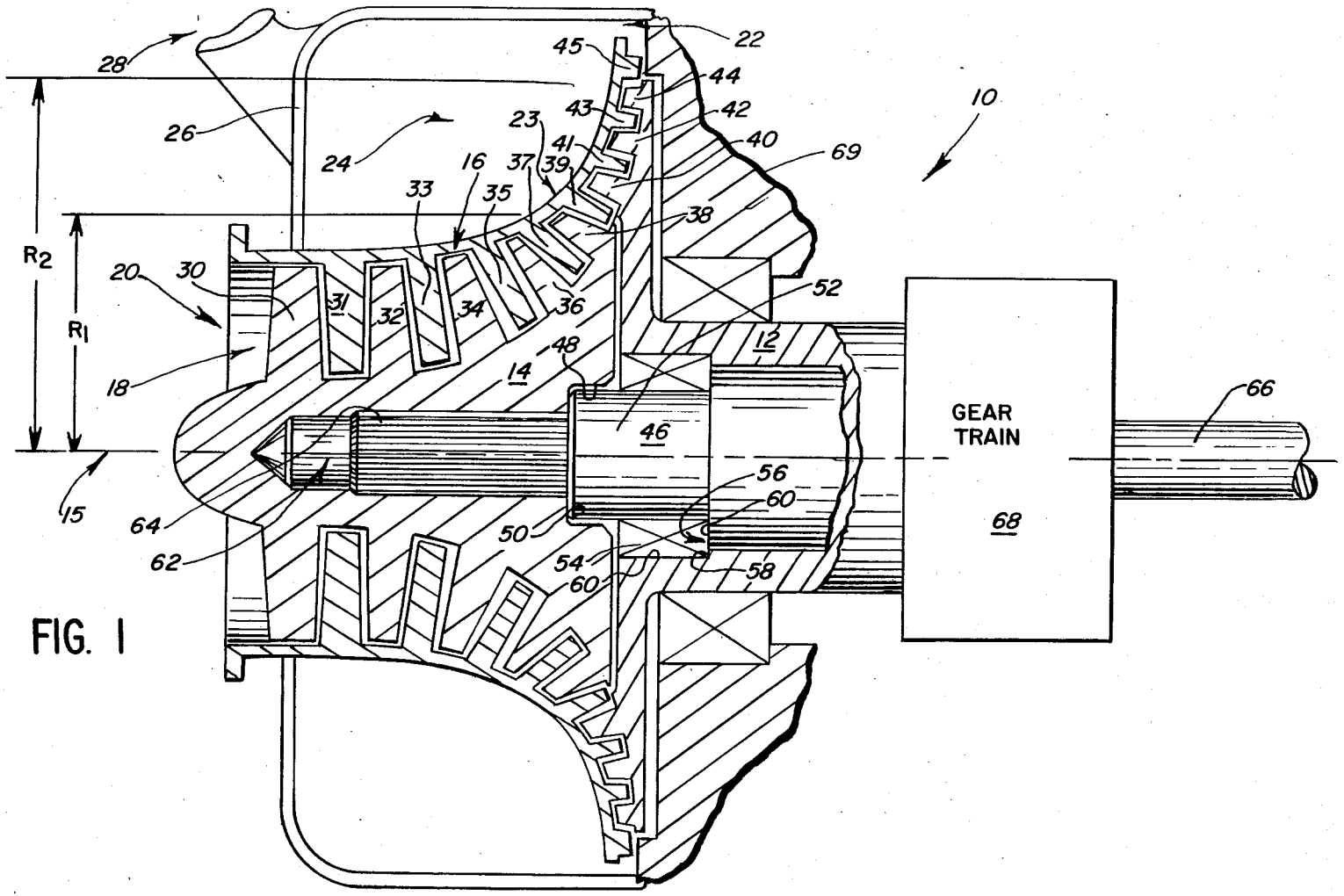
FIG. 1 is a sectional view of the forward compressor section of a gas turbine engine incorporating the rotor of the present invention.

Referring initially to FIG. 1, a multi-stage compressor component, usable in conjunction with a gas turbine engine (not shown), is indicated generally at 10. The compressor includes coaxially aligned, large and small blade carrying rotors 12 and 14 respectively rotating about a central axis 15. An annular, coaxially aligned blade carrying stator 16 is disposed radially outward from the rotors. The bodies of the rotors 12, 14 and stator 16, absent the blading members, define an annular passageway 18 through which a gas traverses from an inlet end 20 towards an outlet end 22.

The bodies of the rotors 12,14 increase progressively in diameter in the direction of flow. The body of the stator 16, absent the blading means, increases progressively in diameter in the same direction, however at a lesser rate, so that the spacing between the rotors 12,14 and the stator 16 diminishes toward the outlet to compensate for the increased diameter of the flow path 18 and the reduced volume of the compressed gas.

The flow path 18 communicates with an annular diffusion chamber 24 disposed in a pocket formed by the diverging stator wall 23. A curved annular wall 26 confines the region about the stator 16 and extends radially sufficiently so as to contain the outlet 22. This particular construction minimizes the radial dimension of the compressor and optimizes space utilization. The compressed gas from the diffusion chamber is discharged through an outlet 28 to be conveyed to a point of use.

Compression of gas is accomplished initially by a first set of compressor blades 30,32,34,36,38 carried on the small diameter rotor 14. The compressor blades are disposed regularly about the circumference of the rotor 14 and extend radially into the region of the annular flow path 18. The length of the blades decrease progressively in proportion to the diminishing spacing between the rotor body and stator body toward the outlet end of the flow path.

Further compression of the gas is accomplished in a second set of compressor blades 40,42,44 carried on the large rotor 12. The second set of compressor blades is mounted and function in the same manner as the preceding blades 30,32,34,36,38.

A plurality of diffuser blades 31,33,35,37, 39,41,43,45 are disposed about the stator member 16 and extend radially into the annular flow path between successive compressor blades. The diffuser blades alternate axially with the compressor blades so that each pair of mated alternate blades (30,31) through (44,45) constitutes a single compression-diffusion stage. Eight such stages are incorporated into the compressor section 10 illustrated in FIG. 1, while the FIG. 2 configuration shows two such stages. The amount of staging employed in a given construction depends on the particular requirements regarding efficiency or other performance factors and forms no part of the invention.

The small diameter rotor is carried by a stepped inner shaft 46. The small diameter rotor 14 includes an expanded cavity 48 at its end closest the outlet 22 defining an annular shoulder 50 against which the expanded middle section 52 of the inner shaft abuts. The middle shaft section carries a bearing 54 which abuts a shoulder 56, defined by an inset wall 58 at the base of an annular recess in the larger rotor 12, and a shoulder 60 on the stepped shaft 46. Thus the large rotor 12 is journaled for rotation relative to the small rotor 14 and about the same axis 15.

The stepped shaft 46, through a reduced end 62, extends into the small diameter rotor 14. A plurality of longitudinally extending splines 64 are disposed circumferentially about the reduced end portion of the shaft 46 and penetrate corresponding grooves within the rotor 14 so as to prevent relative rotation between the shaft 46 and the rotor 14.

The blade carrying rotors 12,14 are driven preferably by a forward extension of the main shaft 66 of, for example, a gas turbine engine. The main shaft 66, through an intermediate gear train 68 rotates the rotors 12,14 at the desired velocity. Though gearing is recommended to couple the high and low speed shafting, the same results can be accomplished electrically, hydraulically or by any like position control means. The specific assembly of the described elements, to include a housing 69, axial retaining means, seals, bearings, etc. as such does not form part of the present invention, in that the required assembly can be accomplished by methods well known in the art.

While the determination of the rotational speed of the rotors depends on the distinct structure and performance requirements, the invention contemplates preferably that the tip speeds of the rotor sections 12,14 be approximately the same. Consequently, the peripheral speed of the blades having the largest radii on their respective rotors should be approximately the same. For example as in FIG. 1, the speed at the tip of the blades at $R_1$ on rotor 14 should approximate the speed at the tip of the blades $R_2$ on rotor 12. The gear train 68 is chosen accordingly.

While in the FIG. 1 configuration only two rotor sections 12,14 are shown, it should be noted that any number of relatively rotatable rotor sections might be incorporated. In all events, it is desirable that the speed of the rotor sections decrease progressively with increasing diameter so that the tip speeds of all sections are approximately the same.

Figure 2:
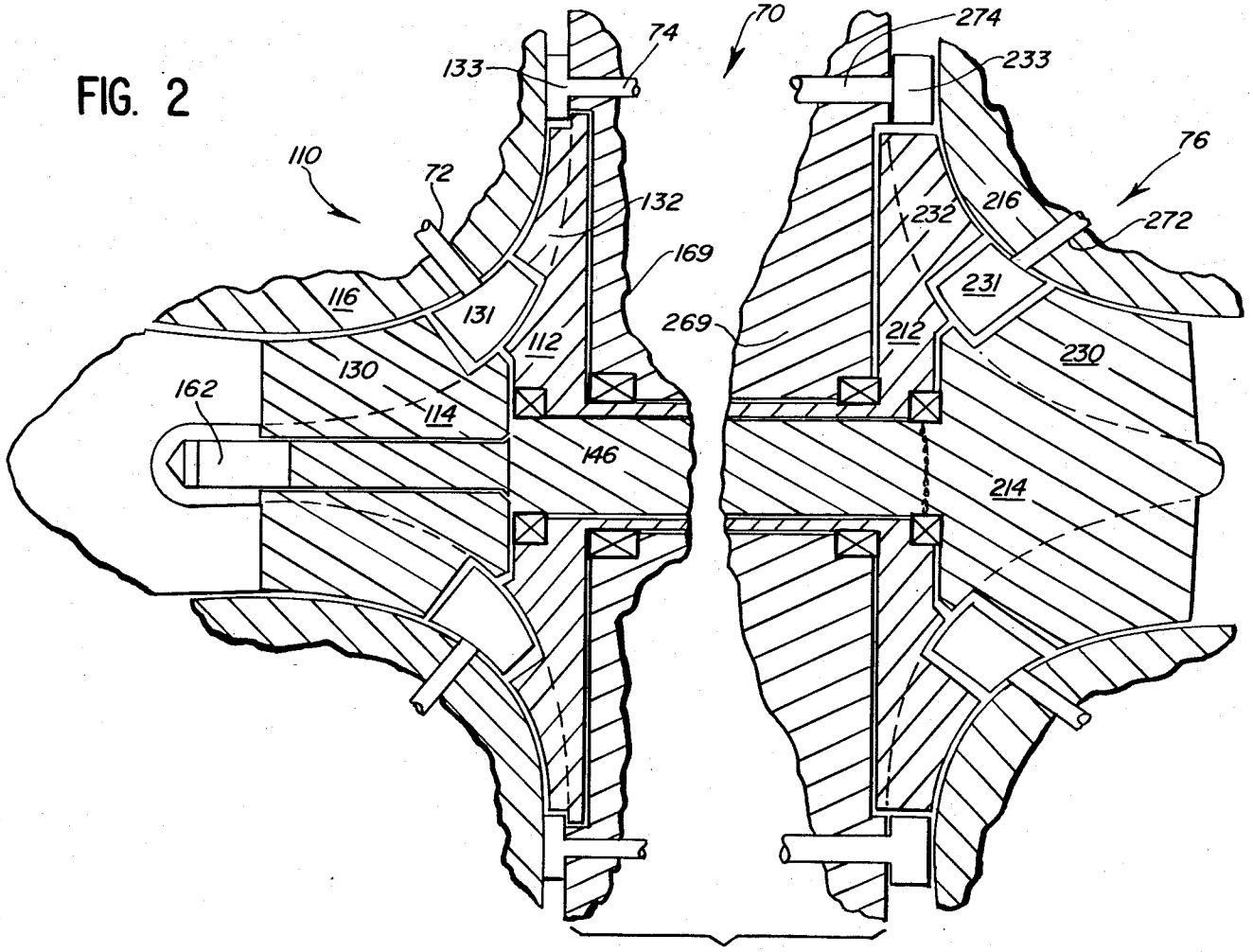
FIG. 2 is a sectional view of a two stage turbocharger incorporating the present invention in both the compressor and turbine sections including adjustable interstage diffuser and nozzle elements.

In FIG. 2, the invention is incorporated into a two stage turbocharger 70. The compressor section, shown generally at 110, operates in the same manner as the FIG. 1 configuration with the exception of the reduction in the number of stages. Large and small diameter blade carrying rotors 112,114 are mounted within a housing 169 and rotatable relative to a stator member 116 and to each other.

To facilitate matching betwen the first and second stages, a diffuser section 131 following a compression section 130 and preceding a second compressor section 132 is adjustable as by appropriate blade adjusting means 72. To improve the overall efficiency of the compressor, a diffuser section 133 adjacent the outlet is likewise made adjustable by suitable means 74. Adjustment of the final diffuser section is useful in matching the outlet pressure with the particular load, which may be an engine. The specific construction of the adjusting mechanism 72,74 for the diffuser sections 131,133 may be conventional and does not form part of the invention, and thus detailed discussion of the same is omitted.

A turbine section shown generally at 76 is built and functions comparably to the compressor section of FIGS. 1 and 2, and includes corresponding rotors 212,214 within a housing 269 and rotatable relative to a stator member 216 and each other. The turbine section 76 may be coupled directly to the compressor section 110 wherein the corresponding rotors 112,212 and 114,214 are mated, as in FIG. 2, or the sections might be operated independently. Nozzle sections 231,233, which include blades that are optionally adjustable by means shown at 272 and 274, alternate with the turbine sections 230,232 with mated pairs 230,231 and 232,233 constituting single and separate stages. The smaller diameter rotor 214 is operated at a greater rotational speed than the larger diameter rotor 212, for the reasons specified previously. Matching tip speeds of the rotor sections in the turbine is likewise preferred. The number of turbine stages, as with the compressor stages, is variable and depends on specific performance requirements.

Adjustment of the blades 131,133,231,233 as by the blade adjusting means 72,74,272,274 effects relative rotation between the large and small diameter rotors respectively 112,212 and 114,214.

The configuration shown in FIG. 2 affords a broad speed and mass flow range as well as high efficiency because of the staging, in spite of giving a high overall pressure ratio. It should be noted that the end portion 162 of the shaft 146 could be extended outwardly (to the left) to tap the mechanical output wherein the apparatus serves as a gas turbine engine.

INDUSTRIAL APPLICABILITY

The coaxial turbomachine can be included in the air compression section at the inlet of a gas turbine engine. Either single or multistage construction is appropriate in utilizing the present invention. In multistage construction, the diffuser section may be adjustable to facilitate matching between successive stages and to ultimately match the engine requirements.

The initial stages, wherein the blades have a reduced diameter, are rotated at greater speeds than the later stages. Preferably the multiple rotors have tip speeds that are approximately the same. The loading of the larger diameter blades is thus kept within the limits of their design without compromising the performance capabilities of the earlier stages.

Alternately, the compression and/or turbine sections of a turbocharger can be constructed in accordance with the present invention. The corresponding rotor segments from each section can be joined or alternately each may be separately controlled. Adjustable nozzle portions may be included at the turbine section, with the remainder of the operating characteristics of the turbine section being essentially analogous to the compressor section.

I claim:

1. A rotary vaned machine comprising:

first and second blade carrying means rotatable about an axis;

blades on each of said blade carrying means, the radial dimensions of the blades varying progressively between an inlet and outlet and increasing from the first to the second blade carrying means;

means mounting said first and second blade carrying means for rotation;

a rotatable drive member interconnected with at least one of the first and second blade carrying means so that the ratio of the rotational velocities of the drive member and said one of the first and second blade carrying members is constant; and means permanently coupling said first and second blade carrying means to each other so that the first and second blade carrying means rotate in the same direction and at different velocities and the ratio of the rotational velocities of the first and second blade carrying means is such that the first blade carrying means is rotated at a greater rotational velocity than said second blade carrying means regardless of the speed of the drive member and so that the tip speeds of the blades on the first and second blade carrying means are approximately the same.

2. A rotary vaned machine comprising:

a plurality of coaxially aligned blade carrying means rotatable about an axis and including a first and a second blade carrying means, which, in conjunction with a stationary third blade carrying means define an annular passageway of progressively increasing radius between an inlet and an outlet of the rotary vaned machine;

a plurality of blades in said passageway and respectively extending from said first, second and third blade carrying means, the radial dimensions of the blades varying progressively between an inlet and outlet and increasing from the first to the second blade carrying means;

means mounting each said first and second blade carrying means for rotation;

a rotatable drive member interconnected with at least one of the first and second blade carrying means so that the ratio of the rotational velocities of the drive member and said one of the first and second blade carrying members is constant; and means permanently coupling said first and second blade carrying means to each other so that the first and second blade carrying means rotate in the same direction and at different velocities and the ratio of the rotational velocities of the first and second blade carrying means is such that the first blade carrying means is rotated at a greater rotational velocity than said second blade carrying means regardless of the speed of the drive member and so that the tip speeds of the blades on the first and second blade carrying means are approximately the same.

3. A multistage centrifugal compressor comprising:

first and second coaxially aligned rotors;

a plurality of compressor blades mounted on each of said coaxially aligned rotors;

a stator coaxially aligned with said rotors;

a plurality of diffuser blades on said stator and arranged between said compressor blades;

said rotors, compressor blades and diffuser blades defining a plurality of stages;

the radial dimensions of the blades on said first and second rotors varying progressively between said inlet and outlet and increasing from the first to the second rotors;

a rotatable drive member interconnected with at least one of the first and second rotors so that the ratio of the rotational velocities of the drive member and said one of the first and second rotors is constant; and means permanently coupling said first and second rotors to each other so that the first and second rotors rotate in the same direction and at different velocities and the ratio of the rotational velocities of the first and second rotors is such that the first rotor is rotated at a greater rotational velocity than the second rotor regardless of the speed of the drive member and so that the tip speeds of the blades on the first and second rotors are approximately the same.

4. The multistage centrifugal compressor of claim 3 wherein the diffuser blades in at least one of said stages are adjustable and a plurality of said adjustable diffuser blades reside between the blades on said first and second rotors.

5. The multistage centrifugal compressor of claim 3 in combination with a gas turbine engine wherein said compressor constitutes the air intake element of said gas turbine engine.

6. The mulitstage centriugal compressor of claim 3 in combination with an engine turbocharger turbine wherein said compressor constitutes the air intake element of said turbocharger.

7. A centripetal turbine of more than one state comprising:

first and second coaxially aligned rotors and a stator, said rotors and said stator defining an annular gas flow passageway therebetween;

a plurality of turbine blades carried on said coaxially aligned rotors;

said stator carrying a plurality of nozzle blades between said turbine blades;

said rotors, nozzle blades and turbine blades defining a plurality of stages;

said gas flow passageway housing said blades and communicating between an inlet and an outlet with the radius of said gas flow passageway decreasing towards said outlet;

a rotatable drive member interconnected with at least one of the first and second rotors so that the ratio of the rotational velocities of the drive member and said one of the first and second rotors is constant; and means permanently coupling said first and second rotors to each other so that the first and second rotors rotate in the same direction and at different velocities and the ratio of the rotational velocities of the first and second rotors is such that the first rotor is rotated at a greater rotational velocity than the second rotor regardless of the speed of the drive member and so that the tip speeds of the blades on the first and second rotors are approximately the same.

8. The centripetal turbine of claim 7 wherein the nozzle blades in at least one stage are adjustable and a plurality of said adjustable nozzle blades reside between the blades on the first and second rotors.

* * * * *